US006019077A

United States Patent [19]

Gorokhovsky

[11] Patent Number: 6,019,077

[45] Date of Patent: Feb. 1, 2000

[54] SPARK PLUG FOR INTERNAL COMBUSTION ENGINE

[76] Inventor: Vladimir I. Gorokhovsky, 2 Laxton Avenue, #212, Toronto, Ontario, Canada, M6K 1K9

[21] Appl. No.: 09/106,122

[22] Filed: Jun. 29, 1998

[51] Int. Cl.[7] ..... H01T 13/20

[52] U.S. Cl. ..... 123/169 EL; 313/141; 313/142

[58] Field of Search ..... 123/169 EL; 313/141, 313/142; 445/7

[56] References Cited

U.S. PATENT DOCUMENTS

| | | | |
|---|---|---|---|
| 3,119,944 | 1/1964 | Lentz et al. | 123/169 EL |
| 3,407,326 | 10/1968 | Romine | 313/141 |
| 3,911,307 | 10/1975 | Goto et al. | 313/141 |
| 4,015,160 | 3/1977 | Lara et al. | 313/141 |
| 4,343,272 | 8/1982 | Buck | 123/169 EL |
| 4,427,915 | 1/1984 | Nishio et al. | 313/141 |
| 4,493,297 | 1/1985 | McIlwain et al. | 123/143 B |
| 5,233,143 | 8/1993 | Hutcherson et al. | 200/144 R |

*Primary Examiner*—Tony M. Argenbright
*Assistant Examiner*—Brian J. Hairston
*Attorney, Agent, or Firm*—Dimock Stratton Clarizio; Mark B. Eisen

[57] ABSTRACT

A spark plug is described incorporating a metal hydride in one of its electrodes thereby being able to generate plasma or ionization in the spark gap for ignition of the fuel mixture in the engine.

4 Claims, 2 Drawing Sheets

SPARK PLUG FOR INTERNAL COMBUSTION ENGINE

FIELD OF INVENTION

This invention is related to spark plugs utilized in internal combustion devices, such as automotive engines and similar devices combusting hydrocarbon containing fuel.

BACKGROUND OF THE INVENTION

Internal combustion engines running on hydrocarbon fuels usually require a spark plug to trigger combustion. Spark plugs are understood to be essentially comprised of two electrodes separated by an insulator and some form of a support structure which can be air-tightly fitted in a combustion engine, such that the two electrodes are immersed in the atmosphere of the combustion engine. The electrodes are at different electrical potentials, most often the electrode in contact with the engine housing acts as ground and the potential of the central electrode is periodically raised to a higher potential, thereby generating a spark, however, a reversed polarity of the applied potential is also possible. The spark dissociates and activates the molecules of the gas located in the gap between the respective surfaces of the electrodes, thereby creating a plasma of activated gas atoms or radicals, which then ignites the air and hydrocarbon containing fuel mixture in the combustion engine. It should be clear from the foregoing that to ensure that the combustion device is working satisfactorily, it is of importance that the spark gap width between the electrode surfaces is essentially kept constant, the electrode surfaces are clean, the electrodes are separated by adequate insulation, and in the absence of electrically conducting surfaces detrimental to plasma generation. To meet these requirements the build-up of deposits on the electrode surfaces and on the adjacent insulator surfaces, as well as surface layers of oxidation products of the electrode materials are to be avoided, all of which are likely to lead to misfiring and/or irregular firing of the spark plug. It is known that over-heating of the electrode surfaces can lead to oxidation and spark erosion, on the other hand, under-heating may lead to carbonaceous deposit formation. Such deposits are frequently encountered in the course of operating conventional spark plugs, and are usually formed by build-up of soot, pyrolytic carbon or high melting point hydrocarbons such as waxes, which in turn may be the consequence of incomplete combustion, temperature variations within the engine, fuel mixtures having inadequate composition, and such like. The above deposits are particularly deleterious, affecting adversely the firing of the spark plug electrodes and hence the combustion of the lean fuel-air mixtures which is often utilized nowadays.

Oxidation and spark erosion of the electrode surfaces will also undermine the efficiency and lifespan of the spark plug. Furthermore, misfiring of a spark plug may result in the production of nitrous oxides, as well as oxidation of some fuel additives which may then result in toxic by-products leading to undesirable and noxious components in the exhaust gases.

There have been several known methods to improve the performance of spark plugs. One of such developments have been modifications made to spark plug geometry. Such modifications are described, for example, in U.S. Pat. No. 4,015,160 issued to Lara et al. on Mar. 29, 1977. Other attempts have been directed to improving ionization in the gas phase by changing the geometry of the spark gap in a particular manner, such as for example, described in U.S. Pat. No. 3,911,307 issued to Goto et al. on Oct. 7, 1975.

Spark plug electrodes made of an oxidation resistant titanium compound dispersed in a noble metal containing matrix are taught by Kanemitsu Nishio et al. in U.S. Pat. No. 4,427,915 issued on Jan. 24, 1989, which is another example of tackling the problem of spark erosion due to oxidation. It is noted, however, that the spark plug electrodes described in U.S. Pat. No. 4,427,915 are likely to be costly to manufacture.

In another approach to improving spark plug performance, the likelihood of formation of carbonaceous deposits and oxidation on and between sparking surfaces is reduced by injecting hydrogen gas, oxyhydrogen gas, oxygen or atomized water into the spark gap between the electrode surfaces. There are other known methods for introducing gases such as hydrogen, utilizing injection devices, for supplementing the fuel combustion efficiency of an internal combustion engine. A device for introducing hydrogen and oxygen gases into the spark gap is described in U.S. Pat. No. 4,343,272 issued to A. C. Buck on Aug. 10, 1982. One of the attendant difficulties in this approach is that injection of the gases needs to be carefully synchronized with engine operation, furthermore separate gas containers need to be accommodated. All in all, gas injection through a nozzle operated in conjunction with a spark plug requires a fairly complex system.

It is noted that engines designed to run on only hydrogen as fuel, generated by heating metal hydrides are also known, but such systems do not require conventional spark plugs, and at any rate, hydrogen engines represent a completely different approach to the problem.

A process utilizing $LaNi_5H_6$ in a spark plug is described in SU 1368936, issued in the former Soviet Union on Jan. 23, 1988, to Kudryash et al. The role of the metal hydride is to provide nascent hydrogen diffusing through a ceramic oxide barrier into the spark gap to enhance ionization when the spark is struck. However, nascent or atomic hydrogen in amounts which is sufficient to have a notable effect on the efficiency of ignition in the spark plug is generated only when the engine is hot. Moreover, the atomic hydrogen is likely to recombine in the spark gap to molecular hydrogen before it can be utilized for increasing the spark plug efficiency. The spark plug of SU 1368936 requires a separate heater to generate hydrogen from the hydride when the engine is cold. The hydrogen is generated as the engine and the spark plug attached to it, attain sufficiently high temperature, and not limited to instances of ignition of the fuel mixture. In other words, a substantial portion of the hydrogen generated by the metal hydride is not used in the sparking step, thus the hydrogen source is likely to get exhausted early in the life of the spark plug.

The object of the present invention is to utilize a metal hydride for enhancing the efficiency and control of hydrocarbon fuel ignition in a spark plug without relying on engine heat or without a need for an additional heater and a ceramic oxide barrier to be incorporated in the spark plug.

STATEMENT OF THE INVENTION

An improved spark plug to be utilized in conjunction with a hydrocarbon fuel burning internal combustion engine has been found. The improved spark plug is comprising:

i) two electrodes spaced from one another by a spark gap, wherein one of said the electrodes comprises an electrically conducting metal hydride;

ii) an insulator member separating said electrodes from one another;

iii) a housing supporting said electrodes and said insulator member, said housing adapted to be mounted within said internal combustion engine whereby said electrodes and said internal combustion engine are capable of coordinated operation; and wherein one of said electrodes is adapted to be connected to an electrical energy source and the other of said electrodes is connected to ground.

Figure 1A:
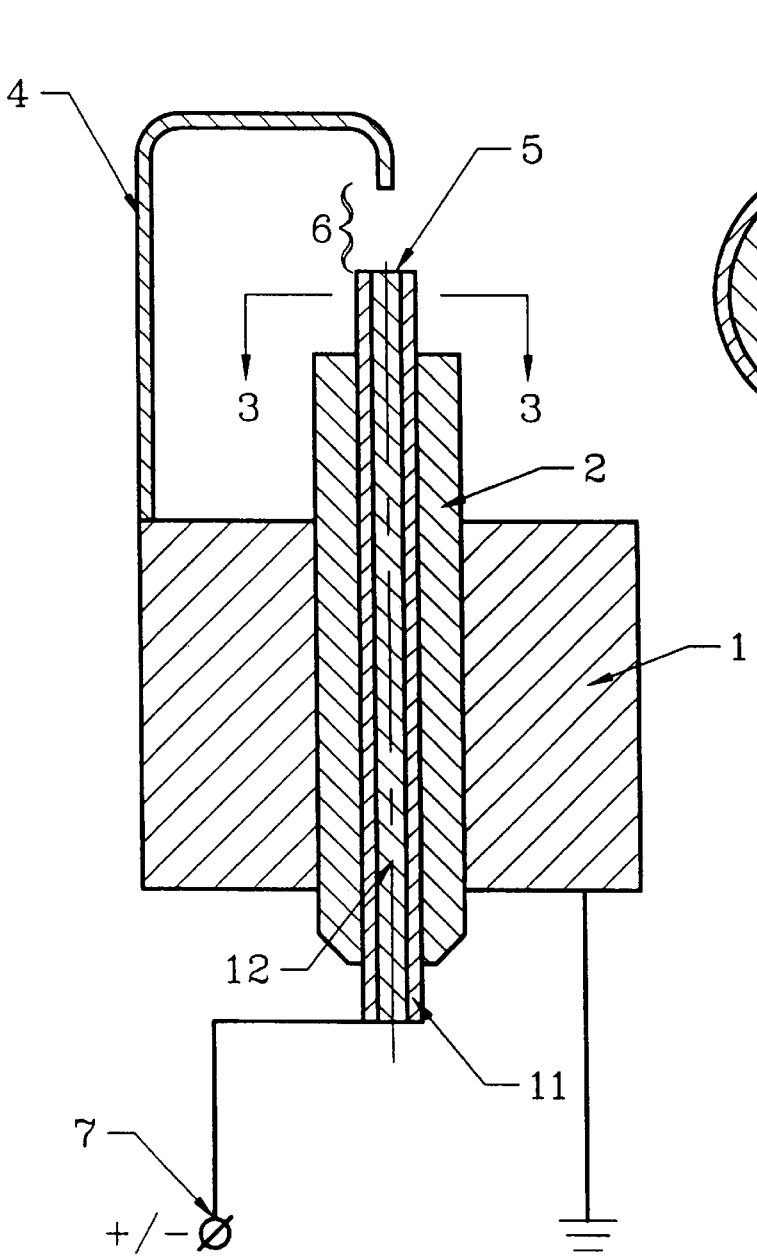
FIG. 1*a* shows a spark plug of the present invention, having a metal tubing packed with a metal hydride as one of the electrodes.

The preferred embodiments of the invention will be described below with reference to the drawings.

As has been discussed above, spark plugs are devices designed to initiate ignition of the fuel mixture in the engine compartment by providing ionization or plasma in coordinated operation with the stroke of an internal combustion engine. Ionization or plasma is generated by striking a spark between the electrodes of the spark plug. The present invention is not concerned with the geometry of the spark plug or the spark gap, only with the composition of the material of which at least one of the electrodes is constructed.

There are several metals which are known to be able to incorporate hydrogen in their structure. The hydrogen may form a stoichiometrically defined compound or alloy with the metal, or may be dissolved or occluded in the structure of the metal in an ordered or disordered configuration. In the following discussion metal hydride is understood to mean both metal-hydrogen compounds, and hydrogen dissolved or/and occluded in a metal and forming stable or meta-stable compositions with the metal under consideration. Typically such metal hydrides will include titanium hydride, nickel hydride, copper-nickel hydride, copper-manganese hydride, titanium-zirconium hydride or a similar transition metal alloy hydride which may be regarded as a chemical equivalent, and palladium which readily dissolves, occludes or absorbs hydrogen reversibly. The hydrogen can be released either from the bulk of the metal hydride or from the surface of the metal hydride under certain circumstances. All the metal hydrides referred to above are electrical conductors.

It has been found that if one of the spark plug electrodes incorporates a metal hydride, such as those discussed above, nascent or atomic hydrogen may be generated when the electrode is subjected to an electrical potential difference or connected to an electrical power source, such as a battery. It is an important feature of the invention that the metal hydride utilized is stable enough not to release hydrogen naturally at the working temperature of the spark plug, that is at the normal running temperature $T_e$ of the engine. In other words, the threshold temperature $T_{th}$ at which the metal hydride starts to release hydrogen in notable amounts, is higher than the working temperature of the internal combustion engine: $T_{th}>T_e$. Furthermore, the hydride in the present invention is required to be an electrical conductor under the working conditions of the spark plug. Most metal hydrides retain the hydrogen atom in the interstitial positions of the metal lattice, thus the metal hydride usually has a wide composition range and hence, it will be able to emanate hydrogen in a relatively wide span of applied electrical potential.

The metal hydrides utilized in the present spark plug are often readily produced by heating the metal or metal alloy in a hydrogen atmosphere. At any rate, the method of production of suitable metal hydrides is beyond the scope of the present invention.

Figure 1B:
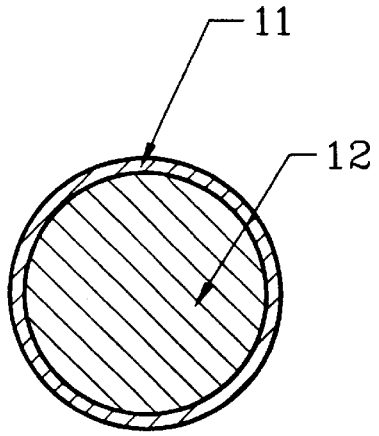
FIG. 1*b* shows the cross-section of the metal hydride electrode.

FIG. 1*a* shows schematically a conventional spark plug, where reference numeral 1 represents a metallic housing or body, which supports the spark plug electrodes and fits into the engine compartment in the usual manner. Electrode 4 is attached to the housing 1. Electrode 4 and the housing may be made of the same metal, or different metals. It is usual but not necessary, that the housing and the electrode in contact with the housing are at ground potential. The other electrode 5 of the spark plug is constructed of a metal tubing 11 packed with a metal hydride 12, such as for instance, titanium hydride or copper-manganese hydride. Tubing 11 is most conveniently made of copper or an alloy of copper, but other metals of high electrical conductivity and appropriate mechanical strength may also be used. Insulator ring 2 is fitted air-tightly into housing 1, enclosing metal conductor tubing 11. The spark gap is indicated by reference numeral 6. As shown, in this embodiment electrode 5 is connected to battery 7, thereby it can be subjected to an electrical potential. The application of an electrical potential to electrode 5 is coordinated by conventional means with the working of the combustion engine. FIG. 1*b* depicts the cross-section of electrode 5 in the direction of arrows 3, showing metal tubing 11 packed with metal hydride 12. The metal hydride may be compacted as metal hydride particles into the tubing 11, or the metal or metal alloy particles may be packed tightly in a non-hydride forming metal tubing and subsequently heated in a pressurized hydrogen containing atmosphere. Other methods for encasing metal hydride are also acceptable, as long as the evolution of atomic hydrogen coincident with the generation of spark can proceed in the spark gap.

Figure 2:
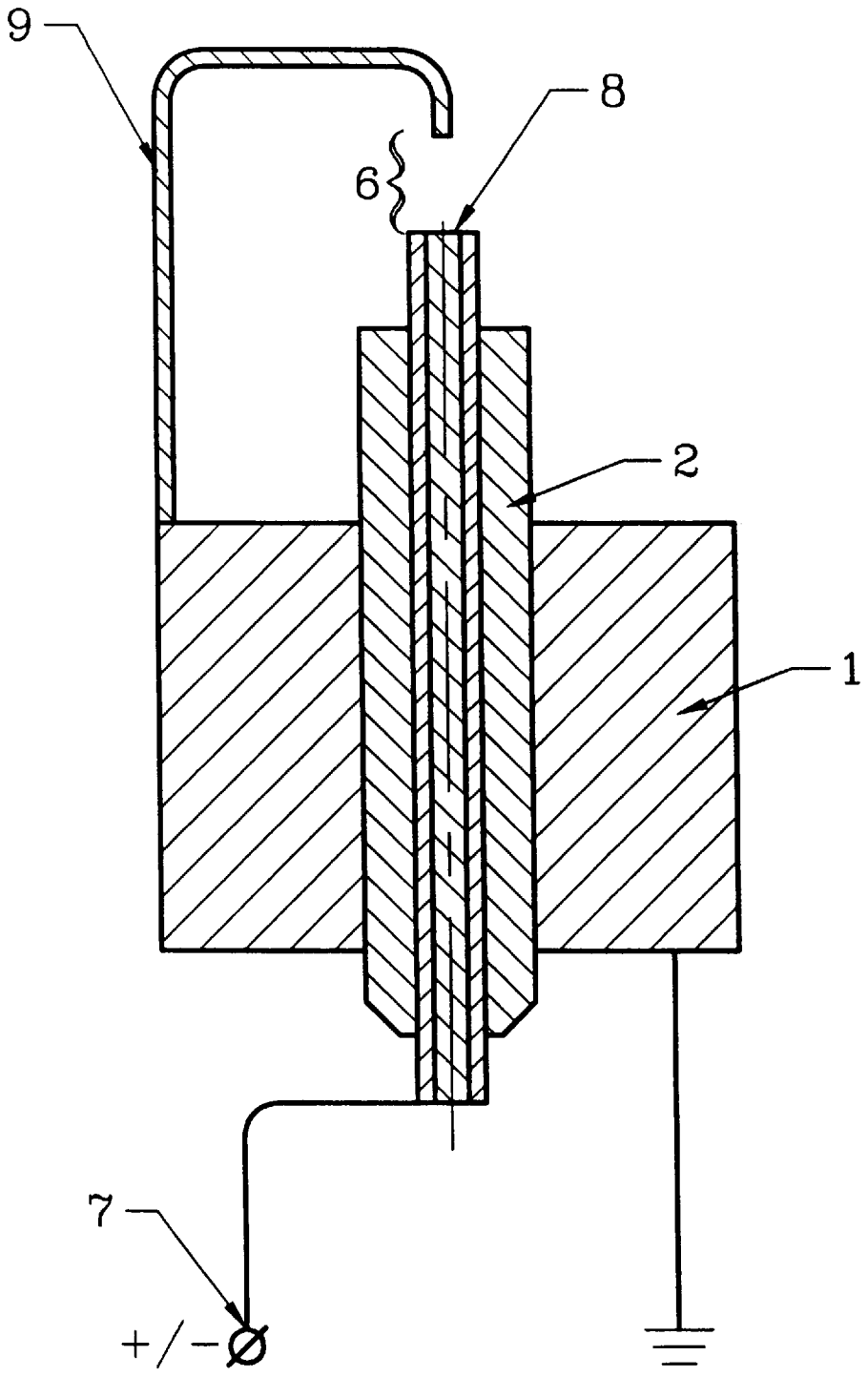
FIG. 2 is a schematic diagram of the spark plug of the present invention having one electrode made of a metal hydride connected to and supported by a metal housing.

Another embodiment of the improved spark plug is shown on FIG. 2. Like numerals indicate like elements of FIG. 1*a*. Electrode 8 may be made of the same metal as housing 1, or it may be a different metal or alloy. Electrode 9 is made of an hydride of an hydride forming metal or an alloy of such, which is supported in electrical contact with housing 1. The surfaces of electrodes 8 and 9 are spaced from one another by spark gap 6. It is convenient to first make the metal of electrode 9 into the required shape, and subsequently subject the metal of the desired configuration and shape to hydridation at high temperature in a pressurized hydrogen containing atmosphere. Other methods known to the technically skilled to obtain an electrically conductive metal hydride of the desired shape and configuration may also be used.

The advantages of the above described spark plug for internal combustion engines include that it can be assembled from conventional spark plug elements and that the metal hydride bearing electrode may also be readily and relatively inexpensively produced. Furthermore, the nascent or atomic hydrogen is generated within the body of the electrode or by desorption from the electrode surface, only when the spark electrodes are subjected to an electrical potential difference, that is, only when activation of the gas in the spark gap is required. Thus the reservoir of atomic hydrogen within the electrode of the spark plug of the present invention is not readily depleted. Furthermore, the energy required to operate the spark plug may be reduced, since the energy required to yield atomic hydrogen under the operative conditions of the present invention is notably less than the energy consumed in the dissociation of hydrogen molecules of conventional spark plugs.

The embodiments of the invention in which an exclusive property or privilege is claimed are defined as follows:

1. An improved spark plug for utilization in conjunction with a hydrocarbon fuel burning internal combustion engine, comprising:

two electrodes spaced from one another by a spark gap, each electrode being adapted to be connected to a pole of an electrical energy source, wherein one of said electrodes comprises an electrically conducting metal hydride packed into a non-hydride forming metal tubing in electrical contact with said one of said electrodes;

an insulator member separating said electrodes from one another; and a housing supporting said electrodes and said insulator member, said housing adapted to be mounted within said internal combustion engine whereby said electrodes and said internal combustion engine are capable of coordinated operation;

wherein one of said electrodes is adapted to be connected to a first pole of the electrical energy source and the other of said electrodes is connected to a second pole of the electrical energy source.

2. An improved spark plug as claimed in claim 1, wherein said electrically conducting metal hydride is selected from the group consisting of titanium hydride, nickel hydride, copper-manganese hydride, copper-nickel hydride, titanium-zirconium hydride and alloys thereof, and occluded hydrogen containing palladium metal.

3. An improved spark plug for utilization in conjunction with a hydrocarbon fuel burning internal combustion engine, comprising:

two electrodes spaced from one another by a spark gap, each being adapted to be connected to a pole of an electrical energy source, wherein one of said electrodes is made of a hydrided metal capable of forming an electrically conducting hydride;

an insulator member separating said electrodes from one another; and a housing supporting said electrodes and said insulator member, said housing adapted to be mounted within said internal combustion engine, whereby said electrodes and said internal combustion engine are capable of coordinated operation;

wherein one of said electrodes is adapted to be connected to a first pole of the electrical energy source and the other of said electrodes is connected to a second pole of the electrical energy source.

4. An improved spark plug as claimed in claim 3, wherein said metal capable of forming an electrically conducting hydride is selected from the group consisting of titanium, nickel, copper-manganese alloy, copper-nickel alloy, titanium-zirconium alloy and palladium.

* * * * *